US009745708B2

(12) United States Patent
Alt

(10) Patent No.: US 9,745,708 B2
(45) Date of Patent: Aug. 29, 2017

(54) DEVICE FOR THE DAMMING OF A LIQUID IN A LIQUID BASIN

(71) Applicant: RASS INTERNATIONAL B.V., Rotterdam (NL)

(72) Inventor: Robert Max Alt, Zoetermeer (NL)

(73) Assignee: Rass International B.V. (NL)

( * ) Notice: Subject to any disclaimer, the term of this patent is extended or adjusted under 35 U.S.C. 154(b) by 0 days.

(21) Appl. No.: 14/902,697

(22) PCT Filed: Jul. 4, 2014

(86) PCT No.: PCT/NL2014/050446

§ 371 (c)(1),
(2) Date: Jan. 4, 2016

(87) PCT Pub. No.: WO2015/002536

PCT Pub. Date: Jan. 8, 2015

(65) Prior Publication Data

US 2016/0168812 A1 Jun. 16, 2016

(30) Foreign Application Priority Data

Jul. 4, 2013 (NL) ..... 2011092
Oct. 3, 2013 (NL) ..... 2011547

(51) Int. Cl.
*E02B 3/10* (2006.01)

(52) U.S. Cl.
CPC ..... *E02B 3/108* (2013.01)

(58) Field of Classification Search
CPC combination set(s) only.
See application file for complete search history.

(56) References Cited

U.S. PATENT DOCUMENTS 4,501,788 A * 2/1985 Clem ..... E02B 3/126 405/107
5,135,325 A * 8/1992 Eddy ..... E02B 15/08 114/229

(Continued)

FOREIGN PATENT DOCUMENTS

DE 100 38 592 A1 2/2002
DE 20 2008 008764 U1 9/2012

(Continued)

OTHER PUBLICATIONS

International Search Report carried out by the European Patent Office for PCT/NL2014/050446 dated Jan. 10, 2014.

*Primary Examiner* — Kyle Armstrong
(74) *Attorney, Agent, or Firm* — Shumaker, Loop & Kendrick LLP

(57) ABSTRACT

A device for the damming of a liquid in a liquid basin including a tubular enclosure suitable for arrangement at an edge of the liquid basin, wherein a longitudinal direction of the tubular enclosure extends substantially parallel to the edge, wherein the enclosure encloses a liquid-fillable space, wherein the enclosure, at an exterior side thereof, facing the liquid basin, is provided with a skirt for being supported by a sloping underground of the liquid basin, seen from the edge, wherein the support during use is carried out in such a way, that a contact surface present between the skirt and the underground remains substantially free from liquid from the liquid basin, wherein the enclosure, near the lower side of the side during use facing the liquid basin, is provided with one or more filling openings, arranged above the skirt, that during use create an open liquid connection between the space and the liquid in the liquid basin.

10 Claims, 3 Drawing Sheets

(56) References Cited

U.S. PATENT DOCUMENTS

| | | | | |
|---|---|---|---|---|
| 5,143,480 | A * | 9/1992 | Scuero | E02B 7/08 405/107 |
| 5,984,577 | A | 11/1999 | Strong | |
| 6,126,362 | A | 10/2000 | Carter et al. | |
| 7,357,598 | B1 * | 4/2008 | Bradley | E02B 3/108 405/111 |
| 2012/0269577 | A1 * | 10/2012 | Christensen | E02B 3/10 405/115 |
| 2015/0096232 | A1 * | 4/2015 | Cadogan | E06B 9/13 49/10 |

FOREIGN PATENT DOCUMENTS

| | | | |
|---|---|---|---|
| JP | S58 47808 | A | 3/1983 |
| WO | 2011/006180 | A1 | 1/2011 |

* cited by examiner

DEVICE FOR THE DAMMING OF A LIQUID IN A LIQUID BASIN

TECHNICAL FIELD AND BACKGROUND OF THE INVENTION

The present invention relates to a device for the damming of a liquid in a liquid basin.

Such a device is known. Typically, in the known damming devices, and in particular, temporary damming devices, use is made of relatively small damming members, such as sand bags, in order to build a device for the damming of a liquid, such as water, at an edge of a liquid basin, such as a dike of a river.

A disadvantage of the existing devices for the damming of liquid, in particular temporary devices, is that the construction thereof takes relatively much time and manpower.

It is therefore an object of the invention to provide a device for the damming of a liquid in a liquid basin, the construction of which requires relatively little time and manpower.

BRIEF SUMMARY OF THE INVENTION

To this end, according to the invention, a device for the damming of a liquid in a liquid basin is provided, wherein the device, during use, comprises a tubular enclosure which is suitable for arrangement at an edge of the liquid basin, wherein a longitudinal direction of the tubular enclosure extends substantially parallel to the edge, wherein the enclosure encloses a liquid-fillable space, wherein the enclosure, at an exterior side thereof, facing the liquid basin, is provided with a skirt for being supported by a sloping underground of the liquid basin, seen from the edge, wherein the support during use is carried out in such a way, that a contact surface present between the skirt and the underground remains substantially free from liquid from the liquid basin, wherein the enclosure, near the lower side of the side during use facing the liquid basin, is provided with one or more filling openings, arranged above the skirt, that during use create an open liquid connection between the space and the liquid in the liquid basin.

The tubular enclosure can be arranged on the edge of the liquid basin relatively easily and quickly, wherein the skirt is supported on the underground in order to keep the tubular enclosure in place. Due to the filling of the liquid-fillable space with fluid or liquid from the liquid basin itself, the tubular enclosure can be weighted relatively quickly by the rising basin liquid so that it is relatively more difficult to move. With the help of this device, an effective device for the damming of a liquid can be provided in a relatively short time and with relatively low manpower. From the state of the art, moreover, devices are known having a tubular enclosure that can be filled with liquid from the outside; however, this liquid usually does not involve liquid from the basin itself, but an external filling liquid. In addition, the filling openings are usually located on the upper side of the enclosure and not at the lower side, above the skirt, in particular almost directly above the skirt, as is the case with the present invention.

Preferably, the tubular enclosure and/or the skirt are pliable and flexible. In order to provide pliability and flexibility, for example, use can be made of a material such as PVC.

An embodiment relates to a device, wherein the tubular enclosure comprises opposite longitudinal ends which are suitable for connection to a longitudinal end of an enclosure of a similar, neighboring device. For example, related devices may be coupled to each other to form a relatively long barrier.

An embodiment relates to a device, wherein the enclosure is provided with one or more stiffening elements to provide shape retention to the enclosure during use.

An embodiment relates to a device, wherein the one or more stiffening elements have a spring-bias in order to cause the tubular enclosure to bulge out during use. Thus, it is made easier for the tubular enclosure to attain its final shape in the position of use, for example, when it has a relatively low rigidity of itself.

An embodiment relates to a device, wherein the tubular enclosure, at the side facing the liquid basin during use, comprises a material having such a density relative to the density of the liquid is that the side remains afloat on the liquid in the liquid basin during use. Thus, it is also accomplished that the tubular enclosure can attain its final shape in the position of use relatively easier.

An embodiment relates to a device, wherein the tubular enclosure in cross-section has the shape of a circle, a triangle or a square. As the skilled person will appreciate, other cross-sections are also conceivable.

An embodiment relates to a device, wherein the skirt can be rolled up around an outer circumference of the tubular enclosure. Thus, the device can be transported and installed relatively easily. However, rolling up in other directions is also conceivable.

An embodiment relates to a device, wherein the skirt at the lower side thereof is provided with an anti-slip layer during use. In this way, the frictional resistance of the skirt, and thus the contact with the underground, is increased.

An embodiment relates to a device, wherein the anti-slip layer comprises an anti-slip profile, such as a ribbed or a grid profile. Such a profile can be applied relatively easily during the production of the skirt.

An embodiment relates to a device, wherein the tubular enclosure, when seen in the longitudinal direction, is provided with one or more transverse bulkheads in order to divide the enclosure in the longitudinal direction in compartments. If there is a compartment that is not functioning properly, this compartment can thus be replaced relatively easily.

An embodiment relates to a device, wherein the skirt comprises a membrane material, which, during use, transports, gas, such as air, from the lower side of the skirt to the upper side of the skirt, but prevents that liquid from the liquid basin is transported from the upper side of the skirt to the lower side of the skirt. Thus, it is prevented in an advantageous manner that gas bubbles can be formed between the underground and the skirt, that deteriorate the seal of the skirt on the underground.

An embodiment relates to a device, wherein the skirt is provided with one or more non-return valves that, during use, cause gas, such as air, to be transported from the lower side of the skirt to the upper side of the skirt, but prevent liquid from the liquid basin from being transported from the upper side to the lower side of the skirt. Thus, the forming of gas bubbles under the skirt is also prevented.

An embodiment relates to a device, wherein the skirt is provided with an integrated air discharge system that transports gas, such as air, from the lower side of the skirt in the direction of the tubular enclosure for discharge to the outside air. Again, the formation of gas bubbles under the skirt is prevented or resisted.

An embodiment relates to a device, wherein the device is provided with a safety system that is designed for detection of irregularities in the tubular enclosure, such as leakage and pressure differences. In particular, when the tubular enclosure is divided into chambers, this safety system can monitor the integrity of these chambers, and subsequently give off a warning when the integrity of one or more of these chambers is at risk. Preferably, the system is coupled to a further system which disconnects the defective chamber from the well-functioning chambers, so that adverse effects of the defective chamber on the other chambers are minimized.

Another aspect of the invention relates to an assembly of a liquid basin, comprising an edge and a sloping underground, when seen from the edge, and an aforementioned device, wherein the tubular enclosure is arranged at the edge of the liquid basin, such that a longitudinal direction of the tubular enclosure is substantially parallel to the edge, the skirt being supported by the sloping underground of the liquid basin, and in such a way, that a contact surface present between the skirt and the underground remains substantially free from liquid from the liquid basin.

Yet another aspect of the invention relates to an assembly of a liquid basin, comprising an edge and a sloping underground, when seen from the edge, and an aforementioned device, wherein the device prior to operational use is stored in a storage, which storage is fixed at a distance from the edge and the underground, in such a way that, in order to achieve operational use, the skirt is displaceable from the storage up to or over the edge for anchoring the skirt on the underground while the tubular enclosure remains positioned in the storage.

An embodiment relates to an assembly, wherein the skirt is provided with an anchor in order to anchor the skirt to the underground. This will further prevent the liquid from the liquid basin to end up between the skirt and the underground, thus causing the skirt to move, or separate from the underground.

An embodiment relates to an assembly, wherein the skirt is provided with weight-increasing means in order to increase the pressure of the skirt on the underground. In this manner, contact with the underground is also increased.

An embodiment relates to an assembly, wherein the liquid basin comprises a water basin, such as a river, lake or sea. The device is in particular applicable to, for example, the (temporary) reinforcement of dikes, dams, and the like.

An embodiment relates to an assembly, wherein the liquid comprises a chemical basin. Also, the device can be used to prevent a chemical basin from overflowing.

Another aspect of the invention relates to an assembly of a liquid basin, comprising an edge and a sloping underground, when seen from the edge, and an aforementioned device, wherein the device is stored in a storage prior to operational use, which storage is fixedly attached to the underground at a distance from the edge of the liquid basin, in such a way that, in order to achieve operational use, the tubular enclosure is displaceable from the storage to the edge by displacement means, and the skirt is positioned on the underground between the storage and the edge during the displacement. In this manner, the device can be made ready for use relatively easily, for example for the reinforcement of a dike at high water, because the tubular enclosure can be pulled or pushed from the storage, such as a cassette, wherein the skirt more or less automatically assumes the desired position on the underground of the liquid basin. The displacement means can moreover be arranged in such a way, that the device can roll out fully automatically, so that the device is ready for use relatively quickly in an emergency.

BRIEF DESCRIPTION OF THE DRAWINGS

The invention will be explained in more detail, based on exemplary embodiments, by means of figures, wherein.

DETAILED DESCRIPTION OF THE INVENTION

Figure 1:
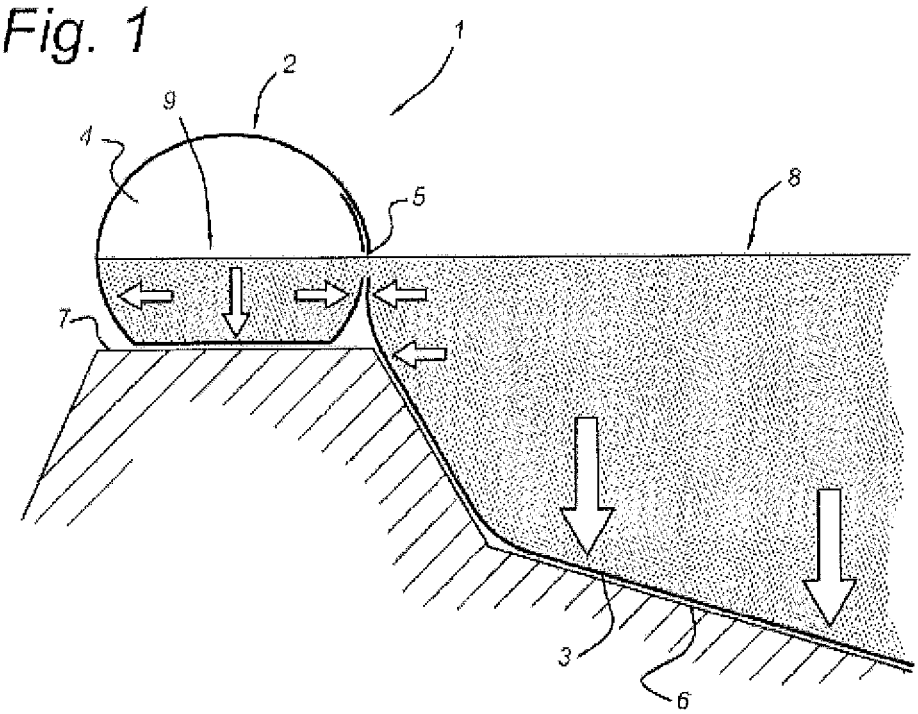
FIGS. 1 and 2 show an exemplary embodiment of a device for the damming of a liquid in the form of river water in a liquid basin in the form of a river.
Figure 2:
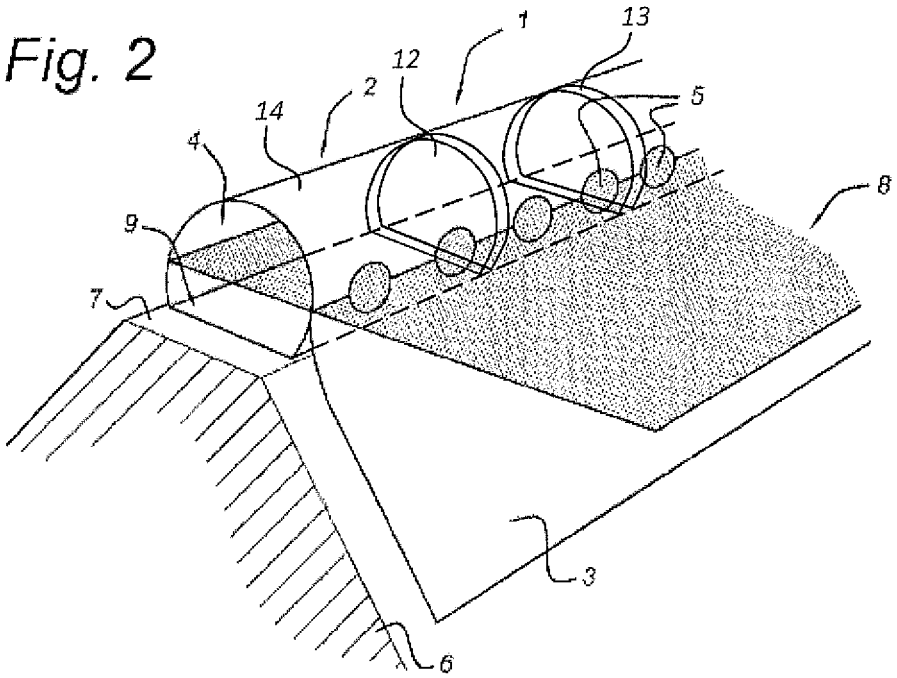

FIGS. 1 and 2 show exemplary an embodiment of a device 1 for the damming of a liquid in the form of river water 8 in a liquid basin in the form of a river. The device 1 as shown has a tubular-shaped enclosure or tube 2 during use, which is suitable for the arrangement on an edge in the form of an dike edge 7 of the river. A longitudinal direction of the tubular enclosure 2 extends substantially parallel to the edge 7 of the dike. In addition, the enclosure 2 encloses a liquid-fillable space 4. The space 4 is provided with one or more filling openings 5, for the filling of the space 4 with the liquid, which in the embodiment shown comprises river water. In longitudinal direction the spacing between the filling openings 5 can be for instance 10-200 cm, more preferably 20-100 cm, even more preferably 30-80 cm to allow sufficient water exchange between the space 4 and the river/liquid basin 8, while the strength of the tubular enclosure 2 remains sufficient. Moreover, the filling openings can have different forms and can be placed at different heights, including being contiguous with an intersection of the tubular enclosure and the skirt. The enclosure 2 is provided with a skirt 3 at an exterior side which faces towards the river. This skirt 3 is supported by the sloping underground 6 of the dike, when seen from the dike edge 7. The support is carried out in such a way that a contact surface present between the skirt 3 and underground 6 remains substantially free from river water from the river 8. The tube 2 can moreover have different geometric shapes, depending on what is the most optimal in a specific situation. The underground 6 can moreover also extend substantially horizontally.

Forces

The force of the water 8 on the skirt 3 provides a kind of vacuum underneath. Due to the mass of the water 8, the water 8 itself creates its own natural pressure and a higher coefficient of friction of the skirt 3 on the underground 6, which skirt for instance can comprise cloth, such as PVC-cloth. The force of the water 8 at the front side of, for example, the tube 2 is handled by the tensile strength of the PVC-cloth, by the water that is already in the tube 2, and the water pressure on the skirt 3. Any wave is absorbed by the flexibility of the front and the water in the tube 2. The round, bulging shape as shown is particularly suited to deflect currents, waves and wind.

The water running into the tube 2 provides a stable back pressure against the front of the tube 2. The water in the tube 2 is largely the pressure which presses against the backside of the PVC-cloth.

The water 8 thus help with making the water barrier 1 stronger. The barrier 1 can fulfill both a mobile as well as a fixed function. The barrier device 1 can be rolled out over the dike to be placed there with a relatively simple operation. Or, the barrier device 1 can be integrated with the dike. The barrier device 1 is filled by the river itself, therefore there is no need for hoses and pumps to fill the barrier device 1.

The barrier device 1 can be made as long as needed, there is basically no limit. The tube 2 of the barrier device 1 is divided into chambers 14, for example, by transverse bulkheads 12, The height of the water barrier 1 is dependent on the thickness of the PVC, The thicker the cloth, the wider and higher the barrier device 1 may be.

The operation of the barrier 1 is to be called simple in nature. The rising water 8 comes to lie on the skirt 3 so that the skirt 3 will naturally become heavier and thus will have a greater resistance to sliding. When the water 8 reaches the barrier device 1 the tube 2 of the barrier device 1 becomes filled through filling openings 5 arranged at the front of the cloth of tube 2. Thus, the barrier device 1 becomes heavier in a natural way and achieves a resistance in a natural way. The barrier device 1 will no longer slide out of place. When the water level rises, the tube 2 of the device 1 becomes fuller or filled more. This has to do with the law of communicating vessels. The water 8, in principle, itself provides the force which is necessary for the stability of the barrier device 1. The higher the water, the more pressure the barrier device 1 can have. The water in the barrier device 1 itself creates a pressure against the front side. It also absorbs the waves somewhat. When the water level drops, the water in the barrier device 1 drops along, which continues until it is empty. Subsequently, the barrier device 1 can be easily stowed away again to be used for a next time.

The barrier device 1 is made to bulge out by using the following principle. Secondly, a barrier device 1 is conceivable, which bulges out when the water rises. This can be realized by using a material having floating capability in the front side of the tube 2.

The bulging out can be achieved in the following way: at a certain distance a slot can be arranged on the cloth of the tube 2, on the bulge or rounding 14, in which slot a batten is arranged that extends from the front of the rounding 14 to the skirt 3 up to the back side of the bulge or rounding 14 down to the ground or just above it, or all the way around. Thus, this is already performed during the setting up of the barrier device 1. Thus, a relatively good water inlet is achieved at the front side of the tube 2.

Material

As material for the barrier device 1 PVC-cloth can be used, but it is quite possible that a special cloth will be developed. A waterproof cloth, of course. As light as possible. Strengthened so that the cloth does not leak quickly or does not leak at all. It is also possible to build up the cloth in several layers The material must be rot-, mildew- and weather-resistant. The intermediate material which is used as a partition between the chambers may be of a different material than the other material. The lower side of the skirt 3 as well as the lower side of the barrier device 1 can have an anti-slip layer or -underground. This can be a ribbed or grid pattern, or a pattern that is somewhat rough to increase resistance. The aim thereof is to increase the frictional resistance.

Stability of the Skirt

Connected to the barrier device 1 is a skirt 3, serving the purpose of providing stability to the barrier device 1. The skirt 3 should be lying rolled out in front of the tube 2 of the barrier device 1. This can be anchored. Or weighted with a weighting at the end of the skirt 3, this only such that the skirt 3 is not lifted by the water when the water 8 rises. The length of the skirt 3 with respect to the height of the tube 2 of the barrier device 1 is important.

The lower side of the skirt 3 may be provided with a frictional resistance increasing underlayer such as a ripple, gauze or wave profile. Because the more resistance the skirt 3 can create, the higher the tube 2 can become relative to the length of the skirt 3. The length of the skirt 3 is dependent on the height of the tube 2. Once the water lies over the skirt 3, the skirt 3 has a natural pressure of the water itself lying on it. The pressure on the skirt 3 is important, there should be no water between the underground 6 and the skirt 3.

Solid Underground:

preventing the presence of water between the skirt 3 and the underground 6 can be achieved in the following manner: a ground plate with a slit is machined in a plate in which the tendon attached to the skirt 3 is arranged. This is covered with a top plate as a result of which the skirt 3 is fixed to a base plate. Due to the bottom of the base plate being provided with waterproof rubbers and sealing material there can be no water to flow under the base plate. Therefore, all the water flows on the skirt 3. A skirt anchor is useful for this. The skirt anchor features a hinge that is flat on the ground in a straight position. The anchor in this case serves as a weighting element that is directed towards the rising water. The anchor has a sloping side that guides the water over the skirt 3. Because the ground anchor consists of a heavy material (stainless steel or heavy plastic for example), it presses itself down to the underground 6. Water will not soon get the chance to flow under the skirt 3. As weighting element metal plates can also be thought of, that are heavy enough to get the water over the skirt 3, thus not underneath the skirt 3.

Soft Underground:

preferably a skirt anchor is used for this, which as mentioned anchors itself into the ground 6. The anchor will be able to be pushed into the soil at a certain angle. The length of the skirt anchor and the angle needed, are variable to the underground and the opportunities that are available. This construction can be advantageously used in a field that is not to become flooded. Also, the barrier device 1 is definitely suitable for dike reinforcement. Also uneven ground and grass pollen do not cause water to be present under the skirt 3. The skirt anchor itself does not consist of a long rod but of all short parts. This has to do with the irregularities in the underground/soil. Thus, the anchor can be formed or plied along the folds.

The said angle is, of course, variable. The piece of the anchor that goes into the soil may contain sharp points. This has the advantage that the anchor can be more easily pushed into the ground. The anchor may have protrusions at the bottom and top of the plate. These protrusions ensure that the anchor can be anchored in the holes provided for at the beginning of the skirt. Thus, the protrusions have the function of achieving demountability of the anchor. The angle of the protrusions may vary, it is determined on the basis of the most favorable possible ratio and possible anchoring and tensile force created by the anchor. The material preferably concerns a steel type that does not oxidize or does not oxidize quickly. Hard plastic is also conceivable.

Air formation which can arise under the skirt should preferably be discharged. The anchor can take care of this via a discharge system. When there is water on the skirt 3, there is the possibility of air bubbles forming under the skirt 3. This does not improve the stability of the device. It is therefore important to provide a cloth or a system that allows the air under the skirt 3 to escape. The possibility should also exist to discharge any water located between the soil and the skirt.

The length of the skirt 3 is determined by the forces that are necessary for the stability of the device. The cloth or canvas may comprise a PVC type that, when seen from below, is air- or water-permeable and, when seen from above, water-repellent. Can be thought to be a kind of membrane cloth. The material that is needed is preferably rot- and mold-free and must be durable. Also, it is possible to have the skirt 3 consist of multiple layers to create the effect of a membrane cloth. Another possibility to let air or water escape from under the skirt 3 is the use of inserts. These inserts are integrated with the skirt 3. These may be different in shape. These are a kind of non-return valves which allow air or water to escape from under the skirt 3 and which prevent water from above to pass through.

Also, it is possible to have the skirt 3 consist of multiple layers so that the air and water that is under the skirt 3 is collected in the skirt, wherein the skirt 3 in turn discharges it into the tubular enclosure 2. The skirt 3 and the front side of the tubular enclosure 2 then consist of one cloth comprising an air discharge system. The air seeks the path of least resistance and will find the way up to the tube 2 through the air discharge system in the skirt.

Rings/mounting points can be created for anchoring the anchors at the front side of the skirt 3, when seen from the waterside. The protrusions of the anchoring plates fall into these recesses in the skirt 3 through which the skirt 3 is fixed to the removable anchors. The anchors can be embedded in a kind of pocket at the front of the skirt. It is important that the anchoring is carried out in an as optimal manner. Such as with cables, pouches, hooks and the like.

The skirt may also be detachable by zipping, or otherwise detachable, to facilitate transport. This can happen with a zipper, Velcro hook system and the like.

The water that is already under the skirt 3 is forced away by the pressure of the water. In this way you create a vacuum beneath the skirt 3. No more water will be able to seep underneath the water barrier 1 anymore. When the water of the tube 2 of the device 1 has reached the barrier device 1, the barrier device 1 will fill up. The barrier device 1 is filled by the law of communicating vessels. The water in the tube 2 is as high as 8 the water in the river. When the water has retreated, the barrier device automatically empties itself. The only thing left to do is then to roll up the barrier device and to stow it away for subsequent use.

Open, woven cloth or cloth with an open structure also gives the skirt the possibility to allow weeds and grass and the like to pass through so as to get a firmer grip on the dike or underground 6. This will mainly apply to a permanent device.

Further Possible Embodiments

If desired, surfaces can be made on the skirt 3, a kind of basins pre-filled with water ensuring that no water can get below the skirt 3. Optionally, honeycomb material can be used herewith.

A further possibility is to incorporate sediment cloth on the skirt 3. A kind of woven cloth that catches sludge so that the fabric is naturally weighted.

One possibility is furthermore to create chambers in the tube 2 with the aid of a sort of insert. The inserts may be, for example, attached by means of Velcro tape and a double zipper.

One possibility is furthermore to drill a tendon into the cloth at the beginning of the skirt 3, which can be anchored to an existing ground profile. Thus, the water has no chance of flowing under the skirt 3.

A further possibility is to have a first part of the skirt 3 comprise a weighted element, for example a rubber strip. This ribbed in length direction of the cloth. This provides better formation to the soil.

A further possibility is to arrange weighting plates at the beginning of the skirt 3. Heavy material, small plates to facilitate the taking of the shape of the underground.

A further possibility is to arrange a ground anchor at the beginning of the skirt 3, so that absolutely no water comes underneath it and the cloth will fix itself through suction. An additional advantage is that a lot of extra tensional force is added.

The cloth is preferably to be kept as light as possible, so that a longer length can be realized in terms of weight.

One possibility is furthermore to use roll trolleys, in which the barrier is stowed away in a rolled-up condition. For longer lengths, large pulleys can be considered, on which the cloth is rolled up, or the cloth is folded in a special way in a carriage/wagon/truck, which cloth in this way can roll out perhaps for kilometers.

Preferably, the fabric of the skirt 3 is not rigid, it should be easy to form to the soil structure.

An open-weave cloth or cloth with an open structure also gives an opportunity to allow weeds and grass and the like to pass through so as to get a firmer grip on the dike or the underground. An as natural integration into the environment as possible can be achieved this way.

A further possibility is that at the beginning of the skirt 3 eyes are created to pin down the skirt 3.

A further possibility is to create rings below the rounding or bulge of the tube with which the tube 2 can be pinned down when there a wind is blowing.

A further possibility is to give the tube 2 stability during setting up by filling it with a small layer of water. Of course, at most up to the filling openings 5 on the front side of the tube 2. However, it should be understood that preferably there are chambers in the tube 2.

One possibility is to connect these chambers in a chain-like manner as a kind of water hose. Otherwise, each chamber must be filled separately. It is possible to create an integrated system that can move in and out of each other as a kind of concertina. So when you pull the device out, automatically a bulge will be created in the cloth.

Another possibility is to create a certain stiffening in the cloth similar to a winding tube, as a wave moving from back to front, wherein, however, it is still possible to roll the device up.

A further possibility is to provide support, rigidity, and additional water barrier through the use of a type of support or rib positioned straight or obliquely below the tube 2. This rib runs in the extension of the tube 2. The rib is very flexible and absorbs any unevenness. The rib may consist of different materials. It also provides a kind of firmness of the tube rounding or bulge. And increases friction resistance against sliding.

Dike Reinforcement:

in principle, the barrier device 1 can be rolled out over the whole dike, depending on any obstacles that are already present. The tubes 2 may be coupled to each other so that the barrier device 1 in principle can be used in an 'endless' manner on long dikes. On a dike, a mobile, but short-lived, application is conceivable, as explained above, but also very much a permanent arrangement. The barrier device 1 may be installed with the dike in an integrated manner. You can think of a kind of tube or box or cassette in which barrier the device 1 is rolled up or folded. The barrier device 1 can be pulled out when needed.

Tube

The tube 2 itself preferably has a reinforcement on the inside. This reinforcement may be accomplished in various ways. One way is a diagonal reinforcement of the front side below at the connection of the skirt 3 to a certain height at the backside of the tube 2. This can consist of one piece or all loose straps.

The height depends on several factors such as the height and forces to be exerted on it. In the diagonal reinforcement recesses are arranged through which the water can be let into the tube.

Another way is to arrange crescents 13 in the tube 2. These are then placed at a certain mutual distance. These crescents 13 run from top to bottom in the tube 2, and may extend to the front of the attachment of the skirt 3. These crescents 13 are, in whole or in part, fixed to the tube 2 from top to bottom.

Another possibility is to arrange a triangular connection in the tube 2, arranged at a certain angle. This triangular connection is connected to all the corners.

There is also the possibility to give the tube 2 itself a double wall. This double wall is then intended for both the external and internal strength.

The tube 2 may further comprise a circular shape with a flattened bottom. This allows for greater stability.

The battens which give firmness to the tube 2 are preferably made of a fairly flexible material such as fiberglass. But obviously multiple materials are conceivable herein. The battens can be arranged in the tube 2 or at the outside of the tube 2. The battens are placed at a certain distance. This distance is usually the optimum distance needed for proper stability and design of the tube.

Instead of battens, use can also be made of compressed air. Inside or onto the tube 2, air channels are arranged, which in an inflated condition provide shape to the tube 2. It is also possible by using compressed air to roll out and install the barrier device 1 as a whole.

In addition, the use of a coil in or on the tube 2 is conceivable to strengthen and shape the tube 2. The internal reinforcement will have to stay in many cases. The coil consists of a metal, plastic or other suitable material. Because of the weight of the water that goes into the tube 2, the bottom of the tube 2 will be wider.

Production

The height of barrier the device 1, as indicated, can be adjusted to different locations. The barrier device 1 is easy to produce by machine. It is certainly not expensive to produce and can be reused. The barrier device 1 may consist of a number of layers. Reinforced PVC-cloth, fiberglass and other strong materials are conceivable, so that a chamber can not tear or crack. The bottom of the skirt 3 may consist of a different material, such as a type of pond film (rubber), i.e. a material that is quick and smooth to adapt to the soil or underground.

Figure 3:
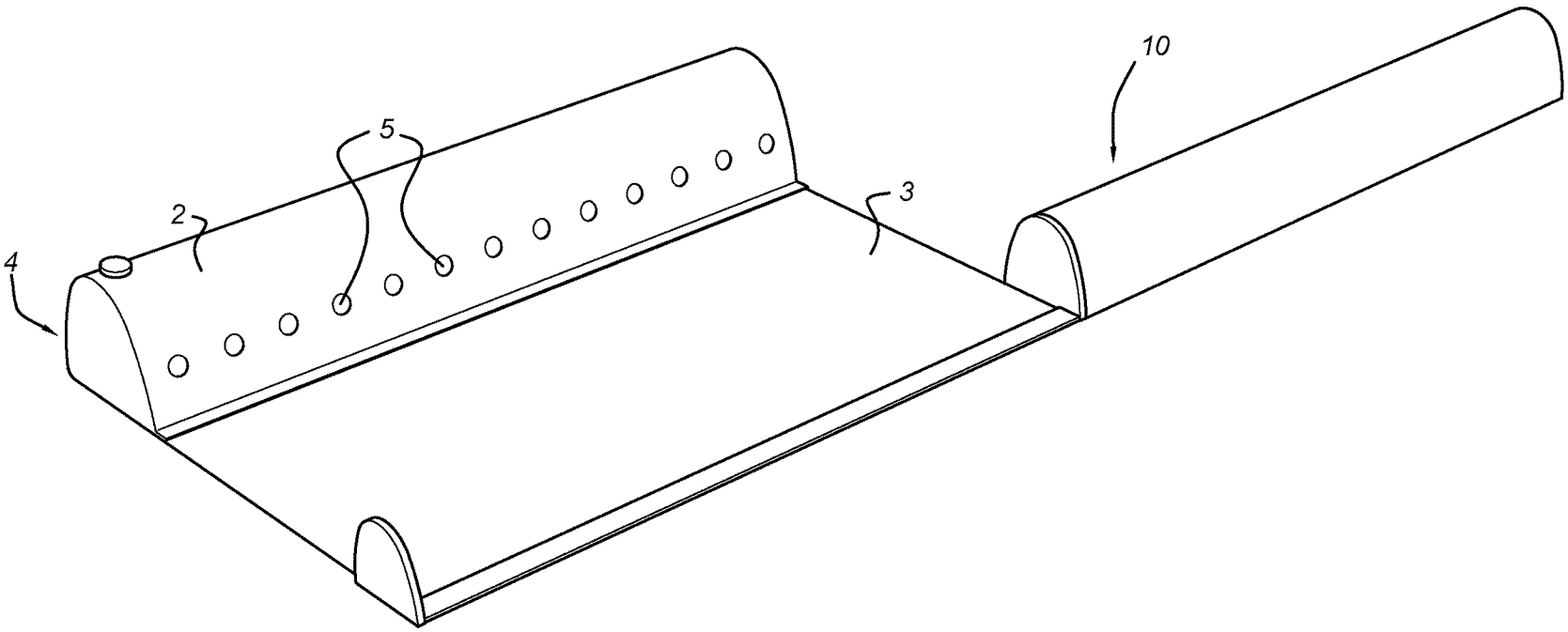
FIG. 3 shows a variant with a liquid basin in the form of a river, comprising an edge in the form of a dike edge and a sloping underground, when seen from the dike edge, wherein the device according to the invention is stored in a cassette prior to use.

FIG. 3 shows a variant with an assembly of a liquid basin in the form of a river, comprising an edge in the form of a dike edge 7 and a sloping underground, when viewed from the edge 7. On the dike a device 1 according to the invention is arranged, wherein the device 1 is stored in a storage in the form of a cassette or cartridge 10 prior to operational use. This storage is located at a distance from the dike edge 7, and is fixedly fastened to the underground 6, in such a way that, in order to achieve operational use, the tubular enclosure or tube 2 is displaceable by displacement means (not shown) from the cassette 10 to the dike edge 7 and during that displacement the skirt 3 is positioned on the underground 6 between the cassette 10 and the dike edge 7.

Cassette System

Figure 4:
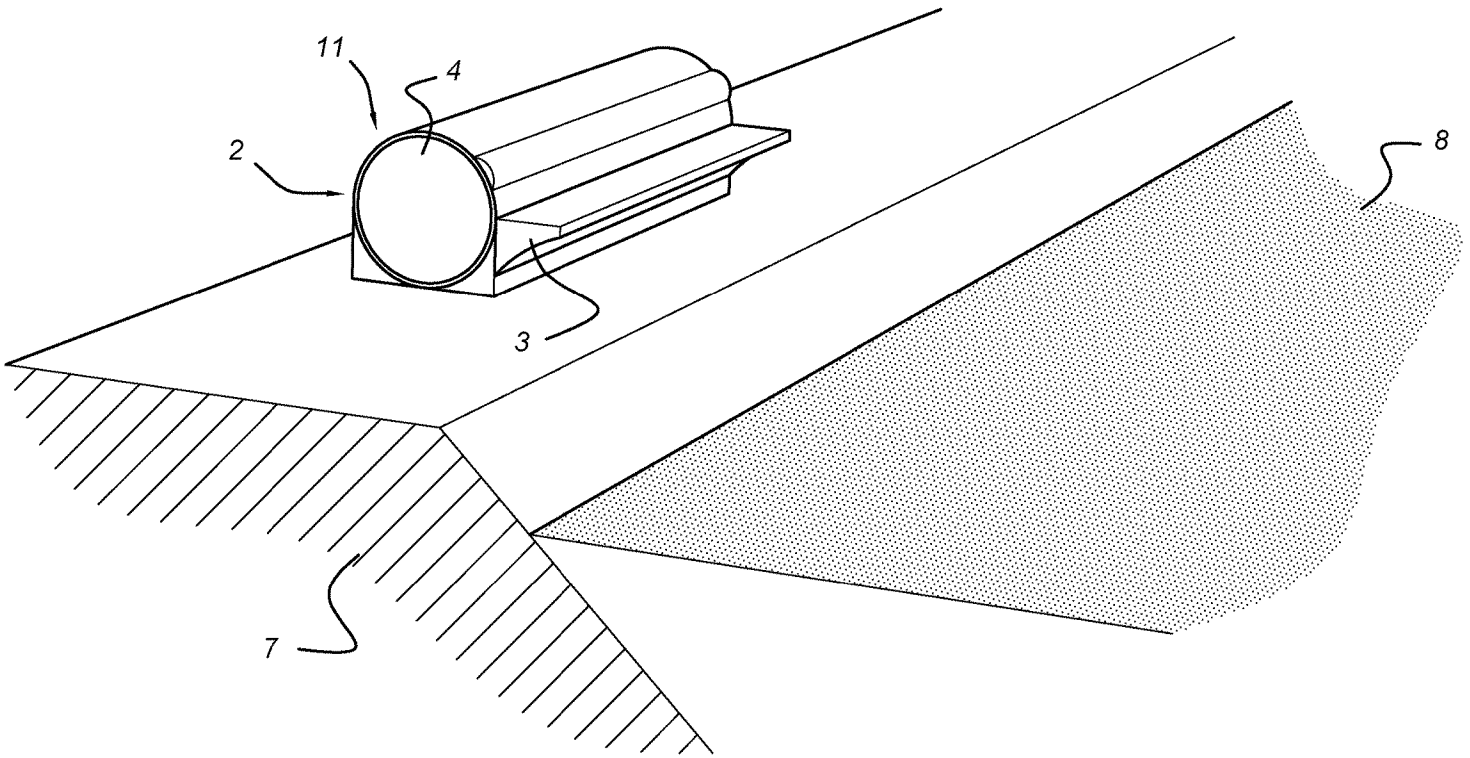
FIG. 4 shows a further variant with a liquid basin in the form of a river, comprising an edge in the form of a dike edge and a sloping underground, when seen from the dike edge, wherein the device according to the invention is stored in a cassette in the form of a bench prior to use.

The cassette system, as shown in FIGS. 3 and 4, consists of a tray or cartridge in which the barrier device 1 has been rolled up. It is intended for a fixed and final set-up. The cassette system can consist of separate elements of a certain length that can be coupled together or anchored by means of a coupling piece not yet described. The cassette 10 is mounted to the underground 6 preventively. The bottom of the cassette 10 has a waterproof barrier, such as rubbers and sealant possibilities to prevent the water from getting a chance to pass underneath the cassette 10, to flow under the skirt 3. The cover of the cassette 10 can be completely removed or folded. The sides of the cap are removable if necessary. After this, the barrier device 1, which was lying in rolled or folded form in the cassette 10, may be completely unrolled. The rounding or bulging may be accomplished using, for example, battens, but this can possibly be integrated with the barrier device 1 itself. The barrier devices 1 are coupled to each other by means of a coupling piece or double Velcro zipper.

The skirt 3 is fixed to the cassette 10, kept as low as possible to the ground so that the water flows faster on the skirt 3, and water has no chance to get under the skirt 3. The cassette system is applicable in many situations. A cassette 10 on a slope of a dike, placing a cassette on a quay. It is even possible to install the cassette 10 on the inside of the quay so that it is not visible. The cassette 10 may have a plurality of forms. This is dependent on the amount of cloth, demand, and applicability.

Quay and Streets:

in many places in the world quays and streets flood with some regularity. Here a cassette system can be used advantageously. On the streets, the fixed barrier device can not be used 'as-is', then there should be a removable version of the barrier device 1. This is with tendon and base plate. The base plate can be placed in front of the flood. The base plate is rounded at the top and hardly felt by traffic. The base plate can also be incorporated in the road, so that the height of the base plate is as high as the road surface. If one removes the upper plate, one can assemble the tendon and skirt. Water now has no chance to get below the skirt.

Storage of the tube 2 may take place in various ways. As already described, by means of rolling, in both length and width. This can also take place by means of a kind of pulley. The tube 2 can also be stored like an accordion. This can be in an elongated cassette 10, 11, where the tube 2 fits into, as shown in FIGS. 3 and 4. The cassette 10, 11 may be provided with adjustments so that the cassette 10, 11 blends into the environment better. The mounting of one or more benches to the cassette is conceivable. Also, color plays a role. On a dike, a green color is less prominent than purple.

The possibility exists for the cassettes 10, 11 to be coupled to the extended water barrier 1. The beginning of the tube 2 connects to the back of the cassette 10, 11 which, in turn, ensures that the tube 2 in pulled-out form is connected to the following cassette 10, 11. In this way, a "dike" of a water barrier is realized. The connection to the cassette 10, 11 can be achieved with a watertight closure. The cassette 10, 11 can be placed almost anywhere. An anchoring in the soil is preferred. The cassettes 10, 11 can be connected with each other by means of, for example, steel cables. These cables or any other type of connection piece can also be used as a guide rail over which the tube 2 is pulled in and out. This will cause the tube 2 to come to lie in a straight line with respect to the next cassette to which the tube 2 is connected. The distance the cassettes 10, 11 mutually have is dependent on the amount of material that will fit in the cassettes 10, 11 in the folded state.

Of course, there is also the possibility to arrange corner elements in different corners of the cassette 10, 11. A cassette-corner element is thereby also more resistant to the forces of water and currents that arise in a corner.

The anchoring of the skirt 3 with this form of storage in a cassette 10, 11 can be realized in a number of ways. A first way is to place a type of rail or attachment points in the ground. The skirt 3 will be attached hereto. This can be a kind of string or hook or snap or a connection system. This rail or the anchor point is situated at a specified point in the ground where the skirt 3 starts, viewed from the waterside. The rail or mounting points can be pre-installed, such that, when high water is imminent, the water barrier can be placed faster.

Separate elements with protrusions in the respective holes in the skirt 3 belongs to the possibilities. These elements are then pushed into the ground, so that the skirt is tightly pressed against the ground and water can not come below the skirt 3. It is also possible to anchor the skirt 3 with pins at the front of the skirt 3. This can be a kind of tent pegs which press the skirt 3 down and hold it in place. Also, the use of any reinforcement elements, such as weights and sandbags as an example, can be used.

Further Applications

Another application is to use the barrier device 1 as a barrier/delimitation for chemicals or other liquids, such as oils. The filling openings 5 at the front side of the barrier device 1 can be used, but then chemicals and oils etc. also flow into the tube 2. This can be avoided by discarding the filling openings 5 at the front side of the tube 2. Here, too, the tube 2 is then pre-filled with water or any other liquid, or raw material. When anchoring the skirt 3, which is directed to the inside, the fixed or permanent set-up with a cassette system or base plate can be used. And on soft ground the ground anchor is also a possibility to use.

The cloth the tube 2 is made of should be resistant to the chemicals and oils.

The barrier device 1 can be used for all sorts of applications, as a barrier, and the separation of liquids and raw materials that are not to be mixed with each other.

The barrier device 1 is also applicable as sea water barrier. For example, a plot of beach that has to be reclaimed or drained is conceivable. At low tide, the barrier device 1 can be installed, so that the ends are located out of the water. The barrier device 1 can be pre-filled with water, then the filling openings 5 at the front side of the tube are not present. The seawater itself can also fill the tube 2 by using the filling openings 5. The skirt 3 can be secured in sand with the ground anchors. In case of a rising tide, sand will lie on the skirt 3 which gives a weighting to the skirt 3. Thus, the tube stays in place better. The advantage of this is that no pumps and the like are required.

Draining of Polders and Meadows:

when the tube 2 is laid from side to side and the water can not flow around the barrier device 1, the tube can be filled with liquid or other material through the filling opening at the top. The filling openings 5 on the front are then omitted again. The barrier device 1 can also be placed in, for example, a flooded polder/section. Rolled onto the water surface, the weighted surface sinks down. This is fixed onto the bottom. The tube 2 is filled with a liquid or a raw material which is heavier than water. As a result, the tube 2 also sinks down to the bottom. The top of the tube 2 protrudes above the water level. Subsequently, the reclamation of the polder/part can begin.

It will be understood that the above description is intended to illustrate the operation of preferred embodiments of the invention and not to limit the scope of the invention. Based on the elucidation above, many variations will be evident to one skilled in the art, that are within the inventive idea and the scope of the present invention.

LIST OF REFERENCE NUMERALS

1. Device for damming water
2. Tube
3. Skirt
4. Fillable space
5. Filling opening
6. Underground
7. Dike edge
8. River water
9. Water in tube
10. Cassette
11. Cassette in the form of a bench

The invention claimed is:

1. A device for damming a liquid in a liquid basin, wherein the device, during use, comprises a tubular enclosure suitable for arrangement at an edge of the liquid basin, wherein a longitudinal direction of the tubular enclosure extends substantially parallel to the edge, wherein the enclosure encloses a liquid-fillable space, wherein the enclosure, at an exterior side thereof, facing the liquid basin, includes a skirt for being supported by a sloping underground of the liquid basin, viewed from the edge, wherein the support during use is carried out such that a contact surface present between the skirt and the underground remains substantially free from liquid from the liquid basin, wherein the enclosure, near the lower side of the side during use facing the liquid basin, includes one or more filling openings, arranged contiguous with an intersection of the tubular enclosure and the skirt, that during use create an open liquid connection between the space and the liquid in the liquid basin such that when the liquid reaches the device the tubular enclosure becomes filled through the filling openings, and when the liquid has retreated, the device automatically empties itself, wherein the tubular enclosure is provided with one or more stiffening elements to provide shape retention to the tubular enclosure during use, such that the shape of the tubular enclosure is substantially maintained during filling and emptying of the device, and wherein a skirt anchor extends continuously along a free end of the skirt to provide a seal between the skirt and the underground.

2. The device according to claim 1, wherein the stiffening elements are in the form of crescents to provide shape retention to the tubular enclosure during use.

3. The device according to claim 2, wherein the one or more stiffening elements in the form of crescents have a spring-bias in order to cause the tubular enclosure to bulge out during use.

4. The device according to claim 1, wherein the tubular enclosure, at the side facing the liquid basin during use, comprises a material having a density relative to the density of the liquid such that the side remains afloat on the liquid in the liquid basin during use.

5. The device according to claim 1, wherein the skirt is rolled up around an outer circumference of the tubular enclosure.

6. The device according to claim 1, wherein the tubular enclosure, viewed in the longitudinal direction, includes one or more transverse bulkheads that divide the enclosure in the longitudinal direction into compartments.

7. A method of assembling a liquid basin, comprising an edge and a sloping underground, viewed from the edge, and a device according to claim 1, wherein the tubular enclosure is arranged at the edge of the liquid basin, such that a longitudinal direction of the tubular enclosure is substantially parallel to the edge, the skirt being supported by the sloping underground of the liquid basin, and such that a contact surface present between the skirt and the underground remains substantially free from liquid from the liquid basin.

8. A method of assembling a liquid basin, comprising an edge and a sloping underground, viewed from the edge, and a device according to claim 1, wherein the device is stored in a storage compartment prior to operational use, which storage compartment is fixedly attached to the underground at a distance from the edge of the liquid basin, in such a way that, in order to achieve operational use, the tubular enclosure is displaceable from the storage compartment to the edge by displacement means, and the skirt is positioned on the underground between the storage compartment and the edge during the displacement.

9. A method of assembling a liquid basin, comprising an edge and a sloping underground, viewed from the edge, and a device according to claim 1, wherein the device is stored in a storage compartment prior to operational use, which storage compartment is fixedly attached to the underground at a distance from the edge of the liquid basin, in such a way that, in order to achieve operational use, the skirt is displaceable from the storage compartment until or over the edge by displacement means for anchoring the skirt on the underground, while the tubular enclosure remains positioned in the storage compartment.

10. A method for damming a liquid in a liquid basin, using a device according to claim 1, comprising the steps of:

placing the tubular enclosure at the edge of the liquid basin, wherein a longitudinal direction of the tubular enclosure extends substantially parallel to the edge;

having the skirt supported by a sloping underground of the liquid basin, viewed from the edge, wherein the support is carried out such that a contact surface present between the skirt and the underground remains substantially free from liquid from the liquid basin; and causing the filling of the liquid-fillable space with liquid from the liquid basin via the one or more filling openings, wherein the liquid from the liquid basin flows into the space.

* * * * *